US011764019B2

(12) United States Patent
Kang et al.

(10) Patent No.: US 11,764,019 B2
(45) Date of Patent: Sep. 19, 2023

(54) ARC EXTINGUISHING CHAMBER BASE OF MOLDED CASE CIRCUIT BREAKER

(71) Applicant: LSIS CO., LTD., Gyeonggi-do (KR)

(72) Inventors: Taeyun Kang, Anyang-si (KR); Wookdong Cho, Anyang-si (KR); Soohyung Kang, Anyang-si (KR); Heonseop Song, Anyang-si (KR); Hangil Kim, Anyang-si (KR); Gunhyun Lee, Anyang-si (KR)

(73) Assignee: LS ELECTRIC CO., LTD., Gyeonggi-Do (KR)

( * ) Notice: Subject to any disclaimer, the term of this patent is extended or adjusted under 35 U.S.C. 154(b) by 359 days.

(21) Appl. No.: 17/044,507

(22) PCT Filed: Jan. 4, 2019

(86) PCT No.: PCT/KR2019/000065
§ 371 (c)(1),
(2) Date: Oct. 1, 2020

(87) PCT Pub. No.: WO2020/004750
PCT Pub. Date: Jan. 2, 2020

(65) Prior Publication Data

US 2021/0110987 A1 Apr. 15, 2021

(30) Foreign Application Priority Data

Jun. 26, 2018 (KR) ..... 10-2018-0073462

(51) Int. Cl.
*H01H 33/72* (2006.01)
*H01H 71/02* (2006.01)
*H01H 73/18* (2006.01)

(52) U.S. Cl.
CPC ..... *H01H 71/025* (2013.01); *H01H 33/72* (2013.01); *H01H 73/18* (2013.01)

(58) Field of Classification Search
CPC ..... H01H 71/025; H01H 33/72; H01H 33/08; H01H 73/18; H01H 9/34; H01H 2009/007; H01H 69/00
(Continued)

(56) References Cited

U.S. PATENT DOCUMENTS 4,975,551 A * 12/1990 Syvertson ..... C08K 5/34922 525/278
6,384,128 B1 * 5/2002 Wadahara ..... C08K 3/04 524/496
(Continued)

FOREIGN PATENT DOCUMENTS

CN 1047680 A 12/1990
CN 1181604 A 5/1998
(Continued)

OTHER PUBLICATIONS

Translation of KR-10-2013-0050275 (original document published May 15, 2013) (Year: 2013).*
(Continued)

*Primary Examiner* — William A Bolton
(74) *Attorney, Agent, or Firm* — K&L Gates LLP

(57) ABSTRACT

The present disclosure relates to an arc extinguishing chamber base of a molded case circuit breaker and, more specifically, to an arc extinguishing chamber base of a molded case circuit breaker, manufactured using a thermoplastic resin. The present disclosure enables an arc extinguishing chamber base for forming a molded case circuit breaker to be manufactured using an aromatic polyamide-based thermoplastic resin, thereby enabling an increase in productivity, a decrease in component weight, a reduction in component production time, an eco-friendly effect, and recycling. Furthermore, component lifespan increases.

10 Claims, 5 Drawing Sheets

(58) Field of Classification Search
USPC ..... 335/202, 201, 135; 200/262
See application file for complete search history.

(56) References Cited

U.S. PATENT DOCUMENTS

| | | | | |
|---|---|---|---|---|
| 6,833,402 | B2 * | 12/2004 | Ouchi | C08K 3/2279 524/464 |
| 7,732,520 | B2 * | 6/2010 | Onizawa | B29C 45/0001 524/451 |
| 2006/0151758 | A1 * | 7/2006 | Reyes | C08K 5/34928 252/601 |
| 2008/0237194 | A1 | 10/2008 | Moore et al. | |
| 2015/0159015 | A1 * | 6/2015 | Benighaus | C08L 23/0869 524/387 |
| 2015/0259589 | A1 * | 9/2015 | Takagi | C09D 201/00 252/75 |
| 2018/0350532 | A1 * | 12/2018 | Liu | H01H 9/02 |

FOREIGN PATENT DOCUMENTS

| | | | |
|---|---|---|---|
| CN | 1182950 | A | 5/1998 |
| CN | 1426592 | A | 6/2003 |
| CN | 1486500 | A | 3/2004 |
| CN | 101183617 | A | 5/2008 |
| CN | 101553536 | A | 10/2009 |
| CN | 101728134 | A | 6/2010 |
| CN | 102568926 | A | 7/2012 |
| CN | 102741323 | A | 10/2012 |
| CN | 103531402 | A | 1/2014 |
| CN | 106816345 | A | 6/2017 |
| EP | 1475817 | A1 | 11/2004 |
| FR | 3058144 | A1 | 5/2018 |
| JP | WO2003044818 | A1 | 3/2005 |
| JP | 2010509419 | A | 3/2010 |
| JP | 2011071048 | A | 4/2011 |
| JP | 2012216470 | A | 11/2012 |
| JP | 2014080627 | A | 5/2014 |
| KR | 20040021583 | A | 3/2004 |
| KR | 20130050275 | A | 5/2013 |
| WO | 02078032 | A1 | 10/2002 |
| WO | 03044818 | A1 | 5/2003 |

OTHER PUBLICATIONS

Japanese Notice of Allowance for related Japanese Application No. 2020-555055; action dated Nov. 30, 2021; (3 pages).
Chinese Office Action for related Chinese Application No. 201980011967.0; action dated Nov. 23, 2021; (8 pages).
International Search Report for related International Application No. PCT/KR2019/000065; report dated Jan. 2, 2020; (5 pages).
Written Opinion for related International Application No. PCT/KR2019/000065; report dated Jan. 2, 2020; (5 pages).
Korean Office Action for related Korean Application No. 10-2018-0073462; action dated May 9, 2019; (4 pages).
Glasscock, et al; "High Performance Polyamides Fulfill Demanding Requirements for Automotive Thermal Management Components".
Extended European Search Report for related European Application No. 19826289.1; action dated Jul. 13, 2021; (7 pages).

* cited by examiner

ARC EXTINGUISHING CHAMBER BASE OF MOLDED CASE CIRCUIT BREAKER

CROSS-REFERENCE TO RELATED APPLICATIONS

This application is the National Stage filing under 35 U.S.C. 371 of International Application No. PCT/KR2019/000065, filed on Jan. 4, 2019, which claims the benefit of earlier filing date and right of priority to Korean Application No. 10-2018-0073462, filed on Jun. 26, 2018, the contents of which are all hereby incorporated by reference herein in their entirety.

FIELD

The present disclosure relates to an arc extinguishing chamber base of a molded case circuit breaker, and more particularly, an arc extinguishing chamber base of a molded case circuit breaker manufactured using a thermoplastic resin.

BACKGROUND

In general, a molded case circuit breaker (abbreviated MCCB), is a circuit breaker housed in a molded case with a rated current of 2500 A or less that is used to protect the low-voltage indoor electrical circuit of 600V AC or less, and 250V DC or less. The MCCB, denoted by the National Electrical Manufacturers Association (NEMA), is the internationally accepted name.

In accordance with the national safety standards of electric equipment and electrical installation guide, installation of an MCCB is a mandatory. The MCCB, provided with an opening and closing mechanism, a trip device, and the like integrally assembled into an insulated container, is an electrical device that causes an electrical circuit in which a current flows to open and close manually or by electrical manipulation, and automatically shuts off the electrical circuit when an overcurrent or short circuit occurs.

The MCCB is designed to prevent damage or fire of a connector, and to prevent an overload and an incident such as a short circuit by quickly shutting off a (power) line when a fault occurs in a circuit.

That is, when a current greater than the rated current flows, the electrical circuit is shut off before a temperature reaches a dangerous level, and when a high fault current, such as a short circuit flows, the electrical circuit is instantaneously shut off.

When a current flowing through a circuit is shut off by contactors, an arc or electric arc (visible plasma discharge caused by an electrical current as an air, normally an insulator, begins to break down and becomes partially conductive) occurs between the contactors, and the arc increases in proportion to the magnitude of current.

An arc has a central temperature of 8000 to 1200° C. and explosive expansion pressure, which may melt the contactor, and deteriorate an insulator.

Here, a case of the MCCB prevents damage caused by this arc, and serves to safely extinguish the arc and protect other parts inside the product.

In association with such an MCCB, the case of the MCCB, in particular, an arc extinguish chamber base uses a material which is made by mixing an unsaturated polyester resin as a main component with a low shrinkage agent, and adding a thickener such as magnesium hydroxide to the mixture. The material is a thermosetting material that has excellent electrical, mechanical, and thermal properties (stability), dimensional stability, and chemical resistance, and is generally used in electrical equipment products that are difficult to use thermoplastic materials.

Sheet molding compound (SMC), bulk molding compound (BMC), and the like are used depending on a method of manufacturing the thermosetting material.

FIG. 1 is a schematic view illustrating a manufacturing process of BMC used in the related art MCCB, and FIG. 2 is a schematic view illustrating a manufacturing process of SMC used in the related art MCCB.

Referring to FIGS. 1 and 2, BMC used for the related art MCCB is a reinforced thermosetting plastic molding material in the form of a bulk, which is prepared by impregnating a matrix, namely, a mixture that an unsaturated polyester resin, a low shrinkage agent, a curing agent, a filler, a release agent, and the like are thoroughly mixed together in a kneader, into glass fibers, which are reinforcing materials.

In addition, SMC is a reinforced thermosetting plastic molding material in the form of a sheet, which is prepared by impregnating a matrix, namely, a mixture that an unsaturated polyester resin, a low shrinkage agent, a curing agent, a filler, a release agent, and the like are thoroughly mixed in a pre-mixer, into glass fibers (1-inch) and thermochemically maturing the composite.

More specifically, SMC and BMC materials primarily composed of unsaturated polyester are used in the MCCB. However, a curing agent is already added in these materials, curing is gradually progressed at a room temperature, which makes it unsuitable to use for a long period of time. Accordingly, physical property variations may occur depending on a storage period of time.

In addition, as the BMC is sensitive to temperature and humidity, physical property variations are large, causing huge seasonal variations in product quality. Further, there is a difficulty or limitation in uniformly dispersing glass fibers during the BMC kneading process, which causes variations in thickness across the area of a part (component or product) when injection molding is performed.

Furthermore, these materials have a very short warranty period of 6 months. When the MCCB is produced by using these materials, it is molded from a thermosetting unsaturated polyester resin that has a slow curing time, thereby requiring a long curing time after molding. Further, as a burr with a stripe-shaped raised edge is caused, a post-treatment process for removing the burr is required, which leads to an increase in production process and working man-hours. As a result, the unit cost of a part is increased.

Moreover, as the thermosetting unsaturated polyester resin that cannot be recycled repeatedly is used as a main material for the MCCB, it is environmentally unsustainable in terms of resource recycling and eco-friendliness.

There are two methods or techniques of producing parts (or components).

FIG. 3 illustrates a configuration of an injection molding machine used for manufacturing the related art MCCB, and FIG. 4 illustrates a configuration of a compression molding machine used for manufacturing the related art MCCB.

As illustrated in FIGS. 3 and 4, the biggest advantage of SMC and BMC materials manufactured by injection molding is that a length of glass fiber (3 to 12 mm), which increases (or reinforces) strength properties, is long, thereby having a very high mechanical strength. However, the glass fiber breaks irregularly when introduced (or fed) into a nozzle 20 after passing through a hopper 20 during an injection molding process, which has high productivity. Strength of parts produced through this process is reduced to ⅕ that of a compression molding process, and thus excellent original characteristics of the materials are not realized.

As for the compression molding, an operator should accurately measure (or weigh) a material (content) before putting it into the mold 40, which increases the process time and decrease the production quantity. In addition, a product quality may vary depending on a measuring amount/measuring size/measuring position/operator, etc.

As the related art MCCB uses the thermosetting resin, it requires a long curing time and a post-treatment process for removing burrs, which increase in production process and working man-hours, thereby increasing the unit cost of a part.

Moreover, as the thermoplastic unsaturated polyester resin that cannot be recycled repeatedly is used as a main material for the MCCB, resource recycling is unavailable, and thus it is not environmentally friendly.

SUMMARY

Therefore, an aspect of the present disclosure is to obviate the above-mentioned problems and other drawbacks, namely, to provide an arc extinguishing chamber base of an MCCB manufactured using a thermoplastic resin.

An arc extinguishing chamber base of a molded case circuit breaker according to one embodiment of the present disclosure may be provided therein with components and installed in a part of a circuit so as to shut off the circuit or allow a current to flow in the circuit. The arc extinguishing chamber base may be made of a material including a thermoplastic resin, and the thermoplastic resin may be an aromatic polyamide-based (polyphthalamide) resin having the following chemical formula.

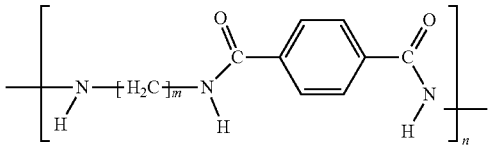

Here, the thermoplastic resin may include a PA66 (polyamide resin) material.

The aromatic polyamide-based resin may consist of 30 mol % or more and less than 100 mol % of aromatic dicarboxylic acid.

In addition, the aromatic polyamide-based resin may consist of aliphatic or cycloaliphatic C4-C15 diamine.

The arc extinguishing chamber base may further include a metal material.

In addition, the arc extinguishing chamber base may further include an inorganic filler, a heat stabilizer, an antioxidant, a light stabilizer, a flame retardant, and a colorant.

The material of the arc extinguishing chamber base may be composed of 30 to 75% by weight of the aromatic polyamide resin, 20 to 65% by weight of an inorganic filler, and 1 to 50% by weight of remaining constituents.

The arc extinguishing chamber base may further include ball particles made of any one of ceramic, glass, and fiber.

As an arc extinguishing chamber base applied to an MCCB according to an embodiment of the present disclosure is manufactured using an aromatic polyamide-based (polyphthalamide-based) thermoplastic resin, it may provide advantages, such as increased productivity, weight reduction of parts, a decreased part production time, eco-friendliness, and recycling.

In addition, a PA66 material is polymerized with the polyphthalamide-based thermoplastic resin for molding, thereby improving physical properties (mechanical properties) of the material are improved.

Further, the polyphthalamide-based thermoplastic resin consists of an aliphatic carbon having 4 to 15 carbon atoms, and also contains 30 to 100 mol % of a benzene ring, thereby greatly improving the physical properties of the MCCB (mechanical properties).

In particular, the thermoplastic resin manufactured with the above composition allows lifespan of parts to be increased, and a property degradation rate overtime to be reduced.

DETAILED DESCRIPTION

Hereinafter, an MCCB according to one embodiment of the present disclosure will be described in detail with reference to the accompanying drawings.

Figure 1:
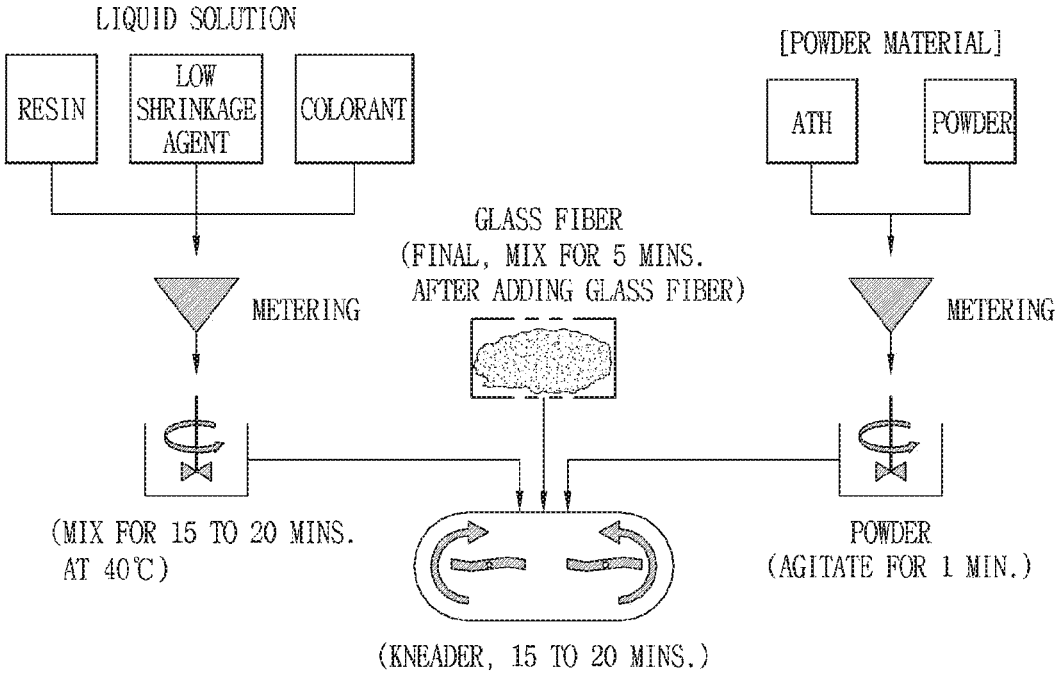
FIG. 1 is a schematic view illustrating a manufacturing process of BMC used in the related art MCCB.
Figure 2:
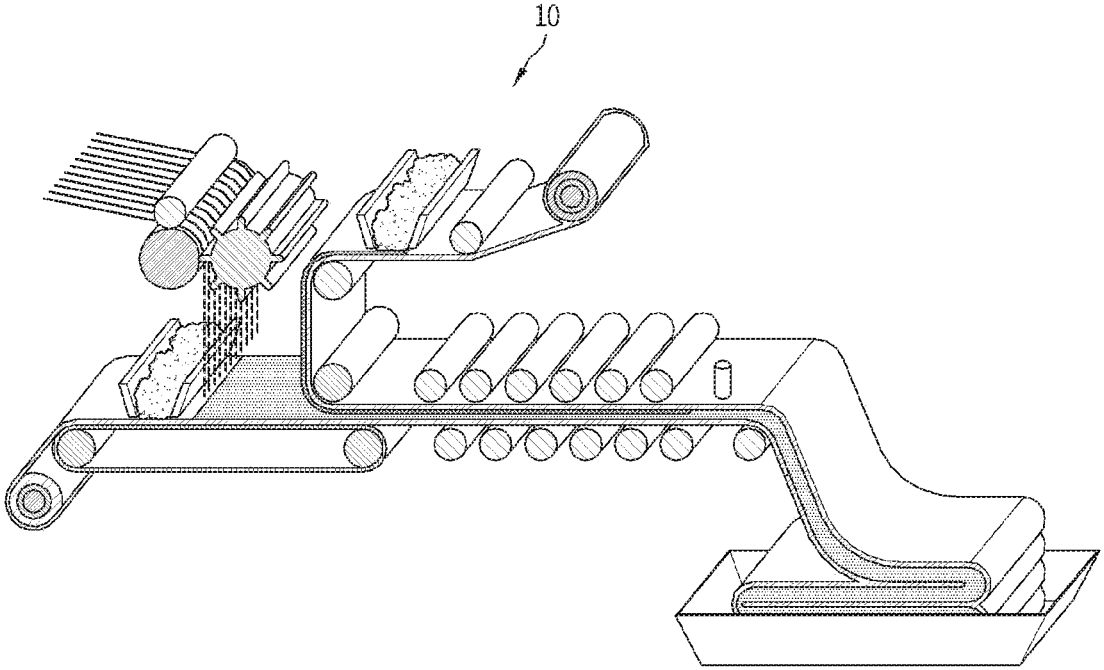
FIG. 2 is a schematic view illustrating a manufacturing process of SMC used in the related art MCCB.
Figure 3:
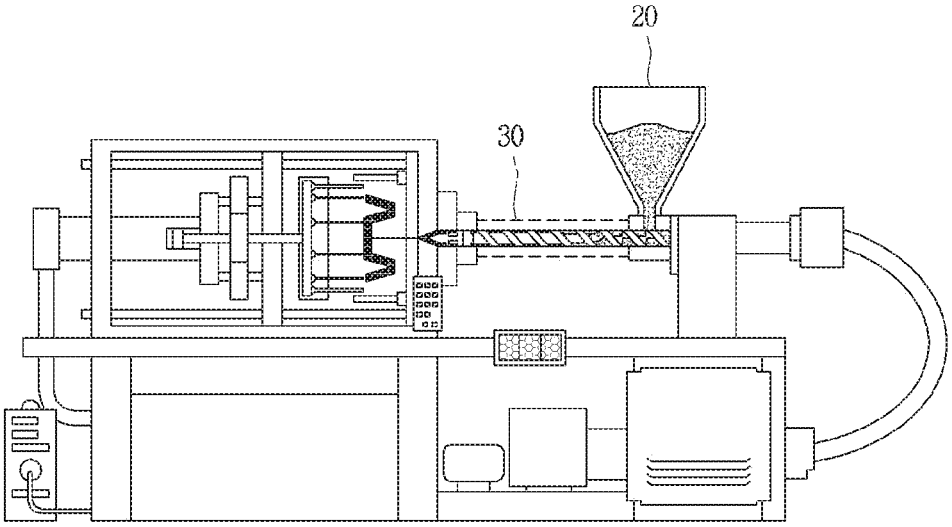
FIG. 3 is a cross-sectional view illustrating an injection molding machine used for manufacturing the related art MCCB.
Figure 4:
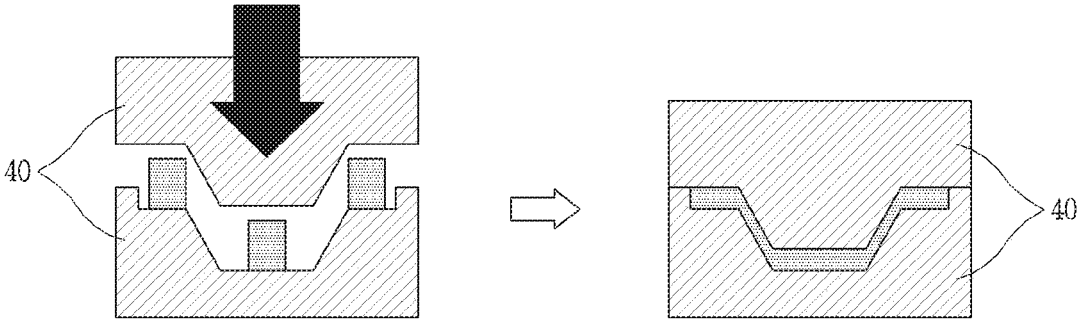
FIG. 4 is a cross-sectional view illustrating a compression molding machine used for manufacturing the related art MCCB.
Figure 5:
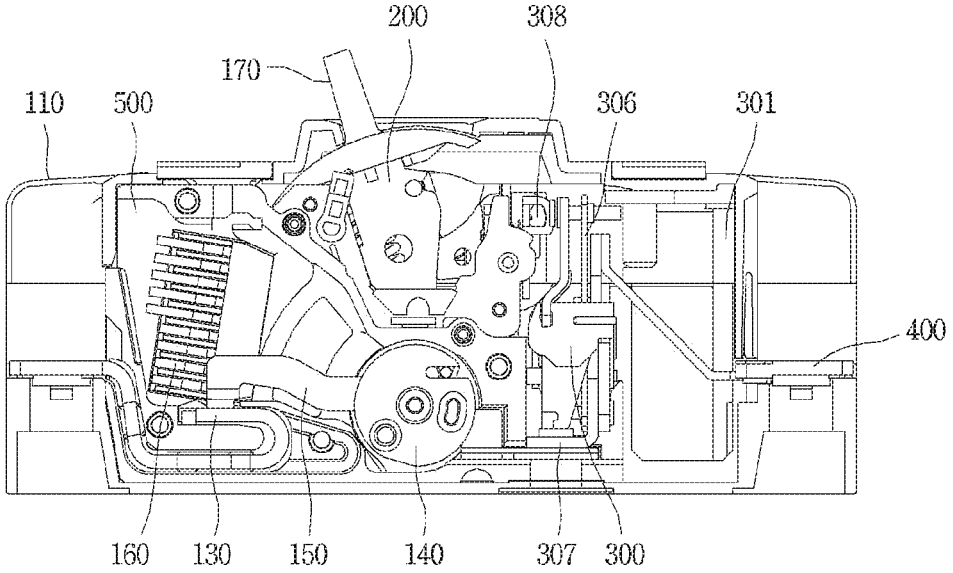
FIG. 5 is a cross-sectional view of an MCCB according to one embodiment of the present disclosure.
Figure 6:
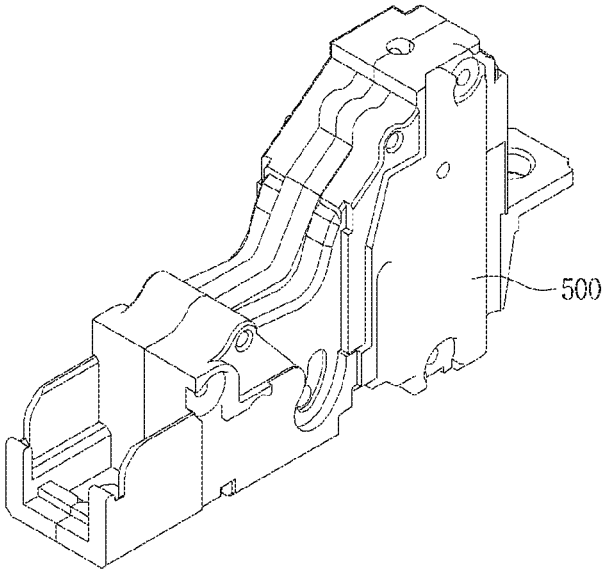
FIG. 6 is a perspective view illustrating an arc extinguishing chamber base applied to the MCCB according to the one embodiment of the present disclosure.

FIG. 5 illustrates an MCCB according to one embodiment of the present disclosure, and FIG. 6 illustrates an arc extinguishing chamber base applied to the MCCB according to the one embodiment of the present disclosure.

Referring to FIGS. 5 and 6, an MCCB 100 according to the present disclosure is installed at a part of a line (circuit) to open and close the line when an overcurrent or fault current occurs. The MCCB 100 is equipped with a trip device to operate an opening and closing mechanism to automatically shut off the line in the event of a fault such as overload, short circuit, and the like, thereby protecting a load and the line.

The MCCB 100 includes a case 110, a fixed portion 130 fixed to a power terminal 120 at one side of the case 110, and a movable portion 150 configured to be rotatable by a shaft 140, an arc extinguishing chamber 160 provided adjacent to contact portions, namely the fixed and movable portions 130 and 150, an opening and closing mechanism 200 configured to rotate the shaft 140 as a lower link (not shown) is interlocked by an upper link (not shown) connected to a handle 170, a trip mechanism 300 that operates the opening and closing mechanism 200 to shut off a current when an overcurrent and a short-circuit current are generated in the line, and a load terminal 400 connected to the trip mechanism 300.

When an overload occurred in the line of the MCCB having such a configuration is an overcurrent, a bimetal 306 fixed by a rivet begins to be curved or bent as heat is generated in a heater 307 provided inside the trip case 301.

As the bimetal 306 is curved, a gap between an adjustment screw 308 disposed on an upper portion of the bimetal 306 and a trip bar 309 becomes narrow, and eventually the adjustment screw 308 pushes the trip bar 309, thereby causing the trip bar 309 to rotate counterclockwise.

At this time, as a shooter (not shown), which is locked (or constrained) by the trip bar 309, is unlocked, the opening and closing mechanism 200 is operated, causing the MCCB 100 to be open.

FIG. 6 illustrates an arc extinguishing chamber base 500 applied to the MCCB 100 according to the one embodiment of the present disclosure. The arc extinguishing chamber base 500 is formed by injection molding or compression molding. The arc extinguishing chamber base 500 is provided with the fixed portion 130, the movable portion 150, the shaft 140, the arc extinguishing chamber 160, and the like. The opening and closing mechanism 200 is installed at an upper side of the arc extinguishing chamber base 500.

The arc extinguishing chamber base 500 of the MCCB 100 according to the present disclosure is molded by using a thermoplastic resin. Here, the thermoplastic resin may be an aromatic polyamide (e.g., polyphthalamide) based resin having the following chemical formula.

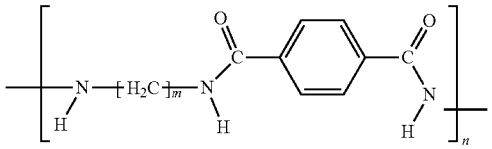

The aromatic polyamide resin includes a repeating unit represented by the chemical formula. Here, $4<m<15$, $50<n<1000$, and each of M and N denotes an integer.

Such an aromatic polyamide-based resin contains a benzene ring, and the aromatic polyamide-based resin is, preferably, composed of 30 mol % or more and less than 100 mol % of aromatic dicarboxylic acid.

Conventionally, polyamide (PA) is generally used as an insulation material for electrical equipment products, which is excellent in electrical insulation, mechanical strength, heat resistance, abrasion resistance, flame retardancy, and moldability. In particular, among others, PA66 and PA6 have been widely used.

In addition, polyamide (PA) has been primarily used for cases of circuit breakers of low-voltage electrical equipment and switchgear products, but it has low heat resistant properties (melting point), making it difficult to be used instead of a thermoplastic resin material (melting point of PA6: 220° C., melting point of PA66: 260° C.)

Thus, in the present disclosure, aromatic polyamide, namely, polyphthalamide (PPA) is used for producing the case 110. The aromatic polyamide (polyphthalamide) has a similar molecular structure to the polyamide (PA). However, unlike a normal PA, the aromatic polyamide has an aromatic (benzene ring) structure, and thereby exhibits high rigidity and mechanical strength, an ability to maintain rigidity at a high temperature (Tm: 290° C.~325° C., Tg: 90° C. 140° C.), high heat resistance, low moisture absorption, dimensional stability and low distortion, chemical resistance, and high property retention for an external environment.

An aromatic ratio of the material used in the present disclosure is 30 to 100 mol %, and an aliphatic carbon chain at both sides of an amide group has 4 to 15 carbon atoms.

In addition, even in the case of an alloy mixed with a material other than a polymerized polymer, an aromatic ratio (or molar proportion) of the entire alloy material may be in the range of 30 to 100 mol %.

The table below shows comparison of the arc extinguishing chamber base manufactured using SMC with the arc extinguishing chamber base 500 manufactured using PPA of the present disclosure.

TABLE 1

| | SMC | PPA |
|---|---|---|
| Density (g/cm3) | 1.73 | 1.65 |
| Tensile strength (MPa) | 39.54 | 196.11 |
| Tensile modulus (MPa) | 9862 | 20017 |
| Elongation (%) | 0.48 | 1.72 |
| Flexural strength (MPa) | 72.94 | 305.39 |
| Flexural modulus (MPa) | 9520 | 17829 |
| Impact strength (KJ/m2) | 11.02 | 8.64 |

It can be seen from the Table 1 that the MCCB 100 according to the present disclosure exhibits more improved mechanical properties, such as tensile strength and tensile modulus, than the related art MCCB manufactured using the SMC because the arc extinguishing chamber base 500 is molded by using the thermoplastic resin, namely, PPA.

The material of the arc extinguishing chamber base 500 includes an aromatic polyamide resin (A), an inorganic filler (B), a heat stabilizer (C), an antioxidant (D), a light stabilizer (E), a flame retardant (F), a colorant (G), and the like.

Here, the inorganic filler (B) may be carbon fiber, glass fiber, boron fiber, carbon black, clay, kaolin, talc, mica, calcium carbonate, aluminum hydroxide, and the like, and be coated with a coupling agent to improve interfacial adhesion with the thermoplastic resin.

A material is, preferably, composed of 30 to 75% by weight of an aromatic polyamide resin, 20 to 65% by weight of an inorganic filler (glass fiber), and 1 to 50% by weight of remaining constituents (or components).

The results of testing the material of the arc extinguishing chamber base 500 using a test piece are presented in Tables 2 and 3 below. In the following examples and comparative examples, only an amount (or quantity) of aromatic polyamide resin (A) was changed, and types and weight ratios of the inorganic filler (B), heat stabilizer (C), antioxidant (D), light stabilizer (E), flame retardant (F), and colorant (G) were the same. Here, the total weight ratio, excluding the aromatic polyamide resin (A), of the material was 55%.

In addition, in consideration of flowability and injection capability (efficiency) during a molding process, a PA66 material was polymerized with an aromatic polyamide resin (A) having an aromatic ring in its main (or backbone) chain instead of solely using the aromatic polyamide resin.

Classification of "Aromatic Polyamide Resin" in this Test (A1) Polyamide resin (PA6T): PA6T, an aromatic polyamide resin containing an aromatic ring in a main chain produced by polycondensation of terephthalic acid and hexamethylenediamine, was used.

(A2) Polyamide resin (PA4T): PA4T, an aromatic polyamide resin containing an aromatic ring in a main chain produced by polycondensation of terephthalic acid and tetramethylenediamine, was used.

(A3) Polyamide resin (PA66): PA66, an aromatic polyamide resin containing an aromatic ring in a main chain produced by polycondensation of adipic acid and hexamethylenediamine, was used.

In the Table 2 below, the ratio (mixed ratio) of (B+C+D+E+F+G) expresses a ratio of those components to the total weight percentage (100% by weight) of the material, and the ratio of A, expressed as weight percentage, is a ratio of the aromatic polyamide resins to one another in a state of excluding B+C+D+E+F+G.

According to the contents of Table 2 below, each constituent was added to be made in the form of a pallet, which was produced through twin-screw melt extrusion, and the pellet was dried at a temperature of 100° C. for 6 hours or more. Then, test pieces for property evaluations (standard ISO test specimen) were produced using an injection molding machine.

TABLE 2

| | Examples (Present disclosure) | | | | | Comparative example (related art) |
|---|---|---|---|---|---|---|
| Composition | 1 | 2 | 3 | 4 | 5 | 1 |
| A1 | 10 | 30 | 50 | 70 | | |
| A2 | | | | | 70 | |
| A3 | 90 | 70 | 50 | 30 | 30 | 100 |
| B + C + D + E + F + G | 55 | 55 | 55 | 55 | 55 | 55 |

TABLE 3

| | | Examples | | | | | Comparative example |
|---|---|---|---|---|---|---|---|
| Items | Properties | 1 | 2 | 3 | 4 | 5 | 1 |
| Basic characteristics | Melting Point (° C.) | 265 | 280 | 295 | 310 | 325 | 260 |
| Original physical properties | Tensile strength (Mpa) | 185 | 190 | 190 | 195 | 200 | 185 |
| | Flexural strength (Mpa) | 290 | 290 | 295 | 300 | 305 | 280 |
| | Impact strength (KJ/m2) | 10 | 9.5 | 9.0 | 8.5 | 8 | 10 |
| | Insulation strength (kV) | 24 | 24 | 24 | 24 | 24 | 24 |
| Physical properties after testing | Tensile strength (Mpa) | 95 | 100 | 110 | 115 | 120 | 80 |
| | Impact strength (KJ/m2) | 8 | 8 | 8.5 | 8.5 | 8 | 7 |
| | Insulation strength (kV) | 20 | 22 | 24 | 24 | 24 | 18 |
| | Lifespan of part (Year) | 10 | 20 | 25 | 35 | 60 | 5 |

The original (or initial) properties of the test pieces after production were measured by performing pretreatment at 25° C. and relative humidity of 50% for 48 hours, and properties after the tests were measured after leaving the test pieces at 180° C. for 648 hours.

Here, the lifespan of part is obtained in the following manner. That is, accelerated life testing was conducted by leaving the test pieces for property evaluations in a gear aging oven at 160° C., 180° C., and 200° C. for 2400 hours, 648 hours, and 480 hours, respectively, in accordance with UL746-b (RTI testing), performing pretreatment on the test pieces under the same condition as the pretreatment above to measure properties, and calculating based on the measured results a time (year) taken for tensile strength properties of the test pieces to be reduced down to 40 Mpa under 100° C., which is an actual operating temperature condition of the arc extinguishing chamber base of MCCB (or simply, MCCB AEC BASE) using the Arrhenius equation. The calculated time is the lifespan of part. The tensile strength of 40 Mpa is the minimum property of tensile strength required for parts to be used in a product.

As such, the polypetalamide-based thermoplastic resin may be used in the arc extinguishing chamber base 500, and a material such as PA66 may be polymerized with the thermoplastic resin for molding.

Regarding the original properties among the properties in the tables above, a support force between polymers is increased by increasing the content of glass fiber or reinforcing agent, thereby increasing mechanical strength.

When the content of the PA66, PA6, PPA, or inorganic filler is the same, the properties of the test pieces are similar.

As the polypetalamide-based thermoplastic resin has a low property degradation rate overtime under a high-temperature operating environment, it can be a good replacement for a thermosetting material. In other words, maintenance of PPA properties rather than original properties is more important for the arc extinguishing chamber base 500. More specifically, it can be seen from the tables, the examples of the present disclosure have better part lifespan than the comparative example. In addition, the mechanical properties, such as tensile strength, impact strength, and insulation strength, are equivalent to or higher than those of the comparative example. Further, in the properties after the tests, the property degradation rate relative to the original properties is lower than that of the comparative example.

In the present disclosure, as the arc extinguishing chamber base 500 constituting the circuit breaker 100 is manufactured using the polyphthalamide-based thermoplastic resin, it may provide advantages, such as increased productivity, weight reduction of parts, a decreased part production time, eco-friendliness, and recycling.

In addition, as the PA66 material is polymerized with the polyphthalamide-based thermoplastic resin, the properties (mechanical properties) of the material are improved.

Further, the polyphthalamide-based thermoplastic resin consists of aliphatic carbon having 4 to 15 carbon atoms, and also consists of 30 to 100 mol % of a benzene ring, thereby greatly improving the properties of the MCCB (mechanical properties).

In particular, the thermoplastic resin manufactured with the above composition allows the lifespan of part to be increased, and the property degradation rate over time to be reduced.

Figure 7:
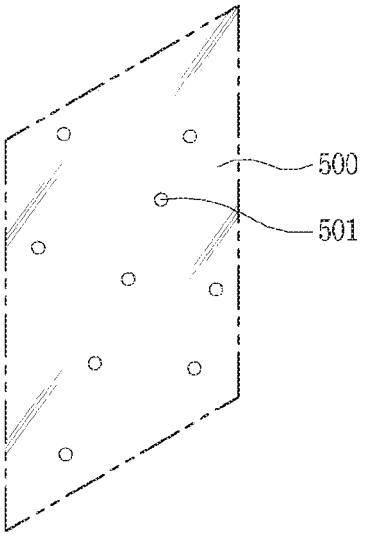
FIG. 7 is a cut view of an arc extinguishing chamber base applied to an MCCB according to another embodiment of the present disclosure.

FIG. 7 illustrates an arc extinguishing chamber base according to another embodiment. In this embodiment, a resin forming the arc extinguishing chamber base 500 includes ball particles 510. The ball particles 501 may be made of ceramic, glass, fiber, and the like. The ball particles 501 may be mixed prior to a plastic injection molding process. This allows mechanical properties such as pressure resistance, impact resistance, and thermal resistance to be further improved.

The invention claimed is:

1. An arc extinguishing chamber base applied to a molded case circuit breaker provided therein with components and installed in a part of a circuit so as to shut off the circuit or allow a current to flow in the circuit, wherein the arc extinguishing chamber base is made of a material including a thermoplastic resin, and wherein the thermoplastic resin includes an aromatic polyamide-based (polyphthalamide) resin having the following chemical formula:

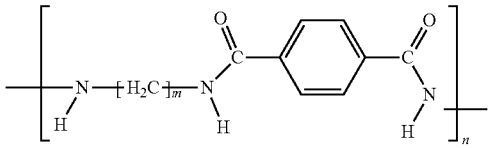

wherein:

the thermoplastic resin includes a PA66 (polyamide resin) material, the aromatic polyamide-based resin consists of 30 mol % or more and less than 100 mol % of aromatic dicarboxylic acid, the aromatic polyamide-based resin consists of cycloaliphatic C4-C15 diamine, the material further includes an inorganic filler, a heat stabilizer, an antioxidant, a light stabilizer, a flame retardant, and a colorant, and the material of the arc extinguishing chamber base is composed of 30 to 75% by weight of the aromatic polyamide resin, 20 to 65% by weight of an inorganic filler, and 1 to 50% by weight of remaining constituents.

2. The arc extinguishing chamber base of claim 1, wherein the material further includes a metal material.

3. The arc extinguishing chamber base of claim 1, wherein the material further includes ball particles made of any one of ceramic, glass, and fiber.

4. An arc extinguishing chamber base applied to a molded case circuit breaker provided therein with components and installed in a part of a circuit so as to shut off the circuit or allow a current to flow in the circuit, wherein the arc extinguishing chamber base is made of a material including a thermoplastic resin, and wherein the thermoplastic resin includes an aromatic polyamide-based (polyphthalamide) resin having the following chemical formula:

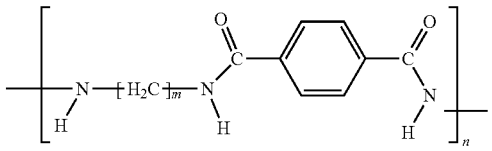

wherein:

the thermoplastic resin includes a PA66 (polyamide resin) material, the aromatic polyamide-based resin consists of 30 mol % or more and less than 100 mol % of aromatic dicarboxylic acid, the aromatic polyamide-based resin consists of aliphatic C4-C15 diamine, the material further includes an inorganic filler, a heat stabilizer, an antioxidant, a light stabilizer, a flame retardant, and a colorant, and the material of the arc extinguishing chamber base is composed of 30 to 75% by weight of the aromatic polyamide resin, 20 to 65% by weight of an inorganic filler, and 1 to 50% by weight of remaining constituents.

5. The arc extinguishing chamber base of claim 4, wherein the aliphatic diamine comprises 5, 7, 9, 11, 13, or 15 Carbon atoms.

6. The arc extinguishing chamber base of claim 4, wherein the aliphatic diamine comprises 4-7 Carbon atoms.

7. The arc extinguishing chamber base of claim 4, wherein the aliphatic diamine comprises 13-16 Carbon atoms.

8. An arc extinguishing chamber base applied to a molded case circuit breaker provided therein with components and installed in a part of a circuit so as to shut off the circuit or allow a current to flow in the circuit, wherein the arc extinguishing chamber base is made of a material including a thermoplastic resin, and wherein the thermoplastic resin is an aromatic polyamide-based (polyphthalamide) resin that consists of cycloaliphatic C4-C15 diamine and having the following chemical formula:

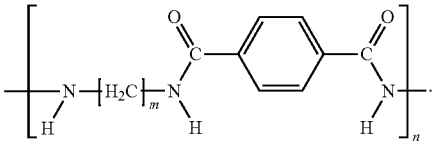

9. The arc extinguishing chamber base of claim 8, wherein the material of the arc extinguishing chamber base is composed of 20 to 65% by weight of an inorganic filler, wherein the inorganic filler consists of:

boron fiber, kaolin, talc, mica, or aluminum hydroxide, and is coated with a coupling agent to improve interfacial adhesion with the thermoplastic resin.

10. The arc extinguishing chamber base of claim 8, wherein the thermoplastic resin consists of 30 to 100 mol % of a benzene ring.

* * * * *